United States Patent [19]

Bernard et al.

[11] 3,953,694

[45] Apr. 27, 1976

[54] MAGNETIC-BLAST ARC EXTINGUISHING DEVICE HAVING PERMANENT MAGNETS

[75] Inventors: Georges Bernard, Saint-Egreve; Pierre Montanier, Grenoble, both of France

[73] Assignee: Merlin Gerin, Grenoble, France

[22] Filed: Aug. 12, 1974

[21] Appl. No.: 496,710

[30] Foreign Application Priority Data

Aug. 30, 1973 France ..... 73.31481

[52] U.S. Cl. ..... 200/147 A

[51] Int. Cl.[2] ..... H01H 33/18; H01H 9/44

[58] Field of Search ..... 200/147 A

[56] References Cited

UNITED STATES PATENTS

| | | | |
|---|---|---|---|
| 2,611,059 | 9/1952 | Immel et al. | 200/147 A |
| 2,896,043 | 7/1959 | Andrews | 200/147 A |
| 3,384,772 | 5/1968 | Rabinowitz | 200/147 A |

FOREIGN PATENTS OR APPLICATIONS

| | | | |
|---|---|---|---|
| 1,236,628 | 3/1967 | Germany | 200/147 A |

*Primary Examiner*—Robert S. Macon

*Attorney, Agent, or Firm*—Stevens, Davis, Miller & Mosher

[57] ABSTRACT

An arc-extinguishing device having a pair of separable electrodes to draw an arc therebetween. A permanent magnet is associated with each electrode and the magnetic fields produced by the magnets are additive to rapidly transfer the arc to diverging parts of the electrodes thereby causing the arc to be lengthened and subsequently quenched. Advantageously the electrodes comprise a pair of offset contact rings.

4 Claims, 6 Drawing Figures

MAGNETIC-BLAST ARC EXTINGUISHING DEVICE HAVING PERMANENT MAGNETS

This invention relates to magnetic-blast circuit interrupters in general and more specifically to arc extinguishing devices having a pair of separable electrodes associated with permanent magnets to draw an arc that is lengthened by the magnetic field produced by the permanent magnets in order to be rapidly quenched.

According to prior-art practice, in certain circuit interrupters of this kind, an arc is drawn between a pair of separating abutment contacts in order to be submitted to additive magnetic fields causing the arc to move between arcing horns but the traveling of the arc roots is not accompanied by a lengthening of the arc so that additional devices are necessary to obtain the extinction of the arc.

In other prior-art circuit interrupters, the interval separating the opening contacts is traversed by opposite magnetic fields which are directed transversely of the direction of the initial arc. A considerable lengthening of the arc is thus obtained but only after a certain time and not from the very beginning of the drawing of the arc. This delay is due to the small magnetic field resulting from subtractive fields produced by the magnets. The delay is still further increased by the magnetic leakage occurring between oppositely polarized magnets. The leakage is most important at the beginning of the opening movement of the contacts because of the small distance separating then the magnets relative to the length separating the polar surfaces of each magnet. This device provides a delayed extinction of the arc causing damage to the contacts such as premature wear.

In a further, known device, coaxial circular permanent magnets associated with ring-shaped separable contacts produce a radial magnetic field in the breaking interval and cause the arc to turn along the circumference of the contacts. The roots of the arc revolve in the same direction along circular paths and the length of the arc depends on the distance separating the contacts in open-circuit position. The lengthening of the arc is very small so that the breaking of high currents becomes very difficult.

It is an object of the invention to provide an arc extinguishing device having permanent magnets to magnetically blast the arc from the very beginning of the opening movement of the contacts, the magnetic blast causing also an important lengthening of the arc and the rapid extinction thereof.

The above and other objects and advantages of the invention will become apparent from the following description of some embodiments of the invention given by way of examples only and shown in the annexed drawings, in which.

Figure 1:
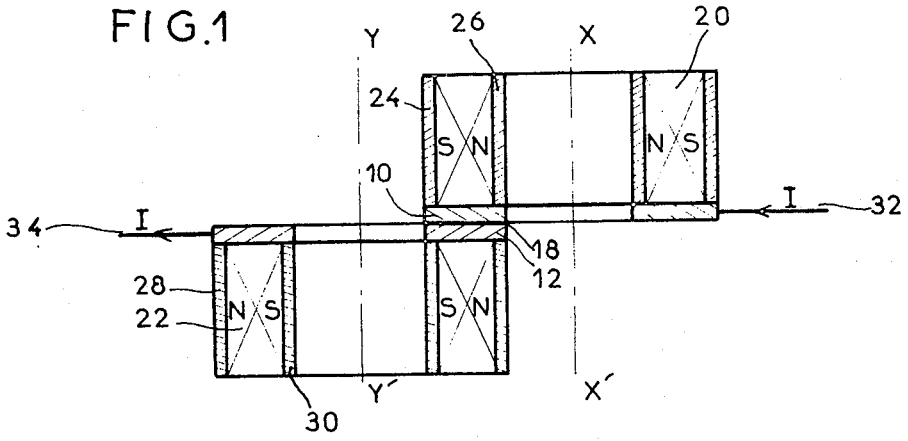
FIG. 1 is a vertical sectional view of a first embodiment according to the invention, the device being shown in the closed-circuit position.
Figure 2:
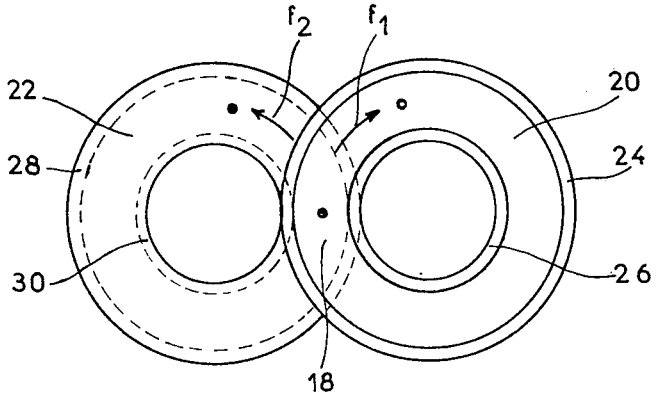
FIG. 2 is a plan view of the device of FIG. 1.
Figure 3:
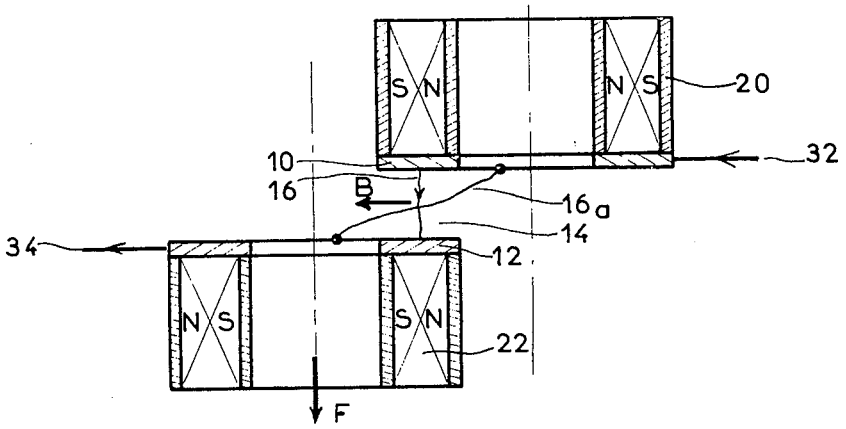
FIG. 3 shows the device of FIG. 1 in the open-circuit position.

Referring now more particularly to FIGS. 1, 2 and 3, there is shown a current-interrupting or arc-extinguishing device having a pair of separable contacts or electrodes 10 and 12 comprising each a flat ring-shaped disc extending in a plane that is perpendicular to the direction of the initial arc 16. The electrodes 10 and 12 are relatively movable in said direction, that is, perpendicularly to their planes, to define in separated position a breaking interval 14 therebetween. The electrodes 10 and 12 are also laterally offset having spaced apart symmetry-axes XX′ and YY′, respectively, so as to present overlapping portions permitting to engage each other at a generally x-shaped contact zone 18 in the closed-circuit position of the electrodes thereby exhibiting a general 8-shape when seen in horizontal projection. Two ring-shaped cylindrical permanent magnets 20 and 22 are carried by the contacts 10 and 12, respectively, so as to move therewith. The magnets are coaxial with the associated contacts and disposed on either side thereof. The magnet 20 is accomodated in the space defined by the confronting wall portions of a pair of coaxial cylinders 24 and 26 which are secured to the contact 10 whereby the diameter of the cylinder 24 corresponds to the outer diameter of the contact and the diameter of the cylinder 26 to the inner diameter of the contact 10. Similarly, the permanent magnet 22 is lodged within the annular space defined between two coaxial cylinders 28 and 30. The cylinders 24, 26, 28 and 30 are preferably made of conductive material and secured to the contacts or electrodes 10, 12 by any suitable means. They may also be made of ferromagnetic material to increase the inductive field. The magnets are radially polarized whereby the annular lateral inner and outer surfaces of the magnet 20 correspond in the embodiment of FIGS. 1, 2 and 3 to a north and a south pole, respectively. The annular lateral inner and outer surfaces of the magnet 22 correspond to a south and a north pole, respectively. It will be seen that the magnets 20 and 22 produce in the breaking interval 14 additive magnetic fields when the electrodes are separated, both fields being directed transversely of the initial direction 16 of the arc, that is, transversely of the direction of translation of the contacts. The contacts 10 and 12 are connected to input and output conductors 32 and 34, respectively. This device operates in the following manner:

In the closed circuit position of the contacts, shown in FIG. 1, the current enters into the device through the conductor 32, flows then through the annular path 10, the common contact zone 18, the path 12 and leaves the device through the conductor 34. At the occurrence of a fault current, the contacts separate, for instance by a translation of the contact 12 in the direction of the arrow F (FIG. 3). An arc having the initial direction 16 is drawn between the separating electrodes in the breaking interval 14. An important magnetic field B resulting from the addition of the constituent fields of the same direction produced by the magnets 20 and 22 is effective from the very beginning of the separation of the contacts. The resultant magnetic field which is directed transversely of the initial direction 16 of the arc transfers the arc away from this initial position whereby each magnet urges the arc root attached to the corresponding electrode along the latter. There is no magnetic leakage between the two magnets 20 and 22 in the formation zone of the arc and the magnetic field B moves the two arc roots initially in the same direction perpendicularly to the plane of the FIG. 3. Subsequently, the roots are urged along divergent paths on the electrodes 10 and 12 according to the arrows $f_1$ and $f_2$ shown in FIG. 2. Thus, the arc roots revolve in parallel planes in opposite directions along the annular electrodes 10 and 12. At a time *t* after the opening of the contacts, the arc is lengthened to occupy a position 16*a*, for example (FIG. 3), between the electrodes 10 and 12. The high flux density in the interval between the electrodes 10 and 12 avoids any stagnation of the arc at the beginning of the opening movement of the contacts and provides a rapid lengthening of the arc causing the extinction thereof. It will be noted that in the shown embodiment the general direction of the arc changes during arc-extinction process, the arc moving progressively from an upright to a more recumbent position.

Figure 5:
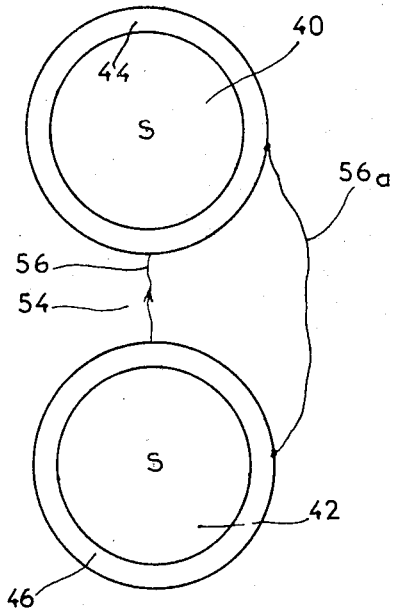
FIG. 5 is a right-hand view of the device according to FIG. 4.
Figure 4:
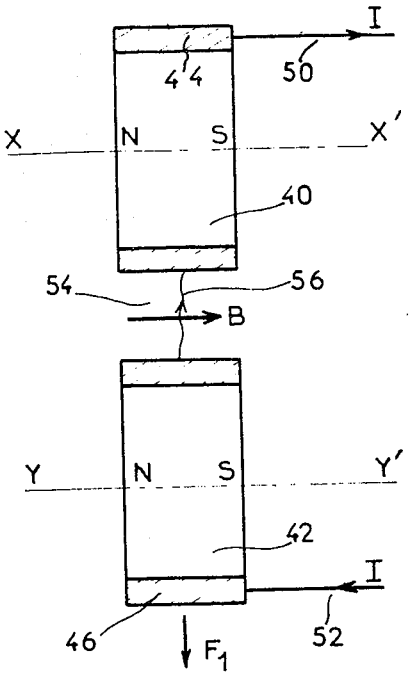
FIG. 4 is a vertical sectional view of a second embodiment according to the invention shown in the open-circuit position.
Figure 6:
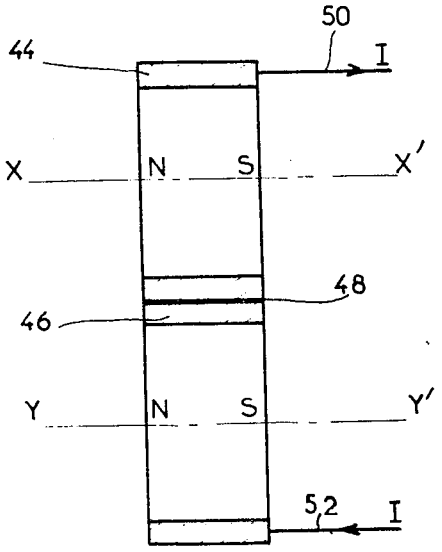
FIG. 6 shows the device of FIG. 4 in the closed-circuit position.

FIGS. 4, 5 and 6 show another embodiment of the invention in which two solid cylindrical magnets 40, 42 are coaxially mounted within separable ring-shaped electrodes or contacts 44, 46, respectively. The contacts 44, 46 have in the closed-circuit position thereof a common contact zone defined by a generatrix 48 extending parallel to the symmetry axes XX′ and YY′ of the contacts 44 and 46. The contacts are connected to input and output conductors 50 and 52 and define in separated position a breaking interval 54 (FIG. 4). The permanent magnets 40 and 42 are polarized in the same direction corresponding to the direction of the axes XX′, YY′. The breaking interval 54 is traversed by additive magnetic fields having the same direction transverse of the initial direction 56 of the arc. No magnetic leakage exists between the magnets 40 and 42.

The device according to FIGS. 4 to 6 operates substantially in the same way as the device according to FIGS. 1 to 3:

At the occurrence of a fault current, the separation of the contacts is brought about by the linear displacement of one of the contacts, for example of the contact 46 in the direction of the arrow $F_1$ shown in FIG. 4. Under the action of the important magnetic field B existing in the breaking interval 54, the arc roots attached to the contacts 44 and 46 move to the right (relative to FIG. 5) starting from the initial position 56 and follow subsequently diverging paths along the electrodes 44, 46. The arc roots revolve in opposite directions along these electrodes and at a time *t* after the beginning of the opening stroke they may occupy a position 56*a* (FIG. 5) in which the total length of the arc is substantially increased relative to the initial length. The important magnetic field existing from the very beginning of the existence of the arc causes the lengthening of the latter and the rapid extinction thereof.

What is claimed is:

1. An arc extinguishing device comprising:

a pair of electrode means separable to draw an arc therebetween and having current-transfer branches engaging each other in the closed position of said electrode means to define a generally X-shaped contact zone, said branches forming in the open position of said electrode means two pairs of diverging arcing contacts for the roots of said arc; and a pair of permanent magnet means disposed on either side, respectively, of the interval separating said electrode means in the separated position thereof to produce in said interval additive magnetic fields directed substantially transversely of the initial direction of said arc to magnetically blast said arc causing said roots to travel rapidly along one of said pairs of diverging arcing contacts thereby lengthening said arc.

2. An arc extinguishing device according to claim 1, said pair of electrode means comprising a pair of offset contact rings extending in planes substantially perpendicular to said initial direction and relatively movable parallel to said direction, said rings overlapping one another to form a generally 8-shaped figure in said closed position.

3. An arc extinguishing device according to claim 1, said electrode means comprising a pair of parallel cylindrical rings engaging one another tangentially in said closed position to form a generally 8-shaped figure in said position, said rings being relatively movable perpendicularly to the axes thereof to draw said arc therebetween, a solid cylindrical permanent magnet being disposed within each ring coaxially therewith, both permanent magnets being polarized in the same direction in such a manner that the magnetic fields produced by said magnets are additive and are directed parallel to the axes of said rings in the interval separating said rings in said open position.

4. An arc extinguishing device comprising:

a pair of ring-shaped electrodes separable to draw an arc therebetween and extending parallel to each other, said electrodes being relatively translatable between a closed-circuit position in which said electrodes engage one another in such a manner as to form a generally 8-shaped figure and an open-circuit position; and a pair of cylindrical permanent magnets secured to said electrodes, respectively, said magnets being positioned and polarized to produce in the interval between said electrodes in separated position additive magnetic fields directed substantially transversely of the direction of relative translation of said electrodes to magnetically blast said arc causing the roots of said arc to travel along diverging parts of the respective electrodes thereby lengthening said arc.

* * * * *